United States Patent [19]

Long

[11] 4,132,210

[45] Jan. 2, 1979

[54] FUEL INJECTION SYSTEM WITH SWITCHABLE STARTING MODE

[75] Inventor: E. David Long, Elmira, N.Y.

[73] Assignee: Allied Chemical Corporation, Morris Township, Morris County, N.J.

[21] Appl. No.: 728,805

[22] Filed: Oct. 1, 1976

[51] Int. Cl.[2] ..... F02B 3/00; F02N 17/00

[52] U.S. Cl. ..... 123/179 L; 123/32 EG

[58] Field of Search ..... 123/179 L, 179 G, 32 EG

[56] References Cited

U.S. PATENT DOCUMENTS

| | | | |
|---|---|---|---|
| 2,867,200 | 1/1959 | Gryder et al. | 123/179 L |
| 3,504,657 | 4/1970 | Eichler et al. | 123/32 EG |
| 3,704,702 | 12/1972 | Aono | 123/32 EG |
| 3,734,067 | 5/1973 | Glockner | 123/179 L |
| 3,771,502 | 11/1973 | Reddy | 123/179 L |
| 3,809,029 | 5/1974 | Wakanatsa et al. | 123/32 EA |
| 3,971,354 | 7/1976 | Luchaco et al. | 123/179 L |
| 4,027,641 | 6/1977 | Moder | 123/179 L |

*Primary Examiner*—Charles J. Myhre
*Assistant Examiner*—David D. Reynolds
*Attorney, Agent, or Firm*—Ernest D. Buff

[57] ABSTRACT

A multi-channel, sequentially timed fuel injection system for an internal combustion spark ignited engine employs a solenoid actuated injector valve for each cylinder controlled by the outputs of separate variable width pulse generators. The pulse generators each employ a resistance-capacitance discharge timing circuit and a single thermistor, common to all the generators, sensitive to engine temperature is connected to the RC circuits of the generators in a first circuit configuration during starting of the engine which provides a wide range of fuel delivery rates for starting and in a second circuit configuration during normal operation in which the various RC circuits are isolated from one another so that interaction of the variable width pulse generators does not occur as a result of the common thermistor connection during normal engine operation.

10 Claims, 5 Drawing Figures

EFFECTIVE PULSE DURATION
160
125
100
75
50
25
0
-20°
+250
ENGINE TEMPERATURE
40
42

ENGINE
IGNITION SYSTEM
16
TO OTHER SPARK PLUGS
14
12
10
TRIGGER COUNTER
20
22
TO OTHER V.W.P.G.
ENGINE SENSORS
32
TO OTHER V.W.P.G.
CONSTANT PRESSURE FUEL SOURCE
30
26
28
VARIABLE WIDTH PULSE GENERATOR
24
VARIABLE WIDTH PULSE GENERATOR
24
TO INJECTOR
TO OTHER V.W.P.G.
MODE SWITCHING
36
START CIRCUIT
38
T
34

FUEL INJECTION SYSTEM WITH SWITCHABLE STARTING MODE

BACKGROUND OF THE INVENTION

1. Field of the Invention

This invention relates to fuel injection systems for internal combustion engines and more particularly to a system for a multicylinder engine having a plurality of time pulse generators incorporating means for modifying the normal operation of the system during start-up of the engine using a single temperature sensor common to all the generators.

2. Prior Art

Recent increases in the cost of fuel and government regulations limiting the permissible quantities of atmospheric pollutants in engine exhaust emissions have increased interest in fuel injection systems as alternatives to conventional carburetors for automobile engines. These fuel injection systems measure engine operating parameters such as manifold pressure and engine temperature and inject measured quantities of fuel, based on these conditions, to the engine cylinders.

My copending patent application, Ser. No. 629,443 entitled "Control Computer for Fuel Injection System" discloses a fuel injection system wherein the quantity of fuel provided to the engine is controlled by an electrically energized injector valve connected to a constant pressure fuel supply. A number of engine sensors control the duration of pulses provided to the injectors by a number of variable width pulse generators, each serving one or more cylinders. One of the sensor signals indicates that the engine is being cranked for starting. When this signal is received the operation of the pulse generators are changed from their normal operating mode. During cold start the injectors then provide enriched fuel charges necessitated by the relatively cold temperature of the fuel and engine which minimizes the vaporization of the fuel charge. At other times the engine may be started while it is relatively hot and a smaller fuel charge, more commensurate with the quantity which would be supplied during normal engine operation will suffice.

Because of the relatively extreme temperature conditions which may occur during start-up, and the need for a relatively large fuel charge, the ratio between the longest and shortest pulse duration which may be required during start-up is substantially larger than the ratio of pulse durations which may be required during normal operation. The ratio between the maximum and minimum pulse durations, over the engine temperature range, required during starting may be ten times as large as the ratio required during normal engine operation over the same temperature range.

Accordingly, some switching mechanism, triggered by the presence or absence of the starting signal, must be provided to switch the mode of operation of the pulse generators to provide two widely different pulse ranges and such circuits have been proposed for systems employing a single pulse generator for all of the injectors. An additional problem is encountered in systems of the type described in the aforesaid patent application, wherein a plurality of injector actuation circuits provide sequential outputs during the engine cycle for different cylinders. During start-up operation the pulses that these multiple generators provide will not typically overlap despite the possible long duration of the pulses, because of the very low engine speed; however, during normal engine operation at higher speeds the pulses may overlap and if the overlapping generators employ any common components, such as a single temperature sensor, cross-modulation can occur resulting in pulse durations during these overlapping periods which are different from the periods produced when only a single generator is being actuated.

One solution to the problem would be to provide separate sensors for each pulse generator, but this is an expensive, awkward alternative. The present invention is accordingly directed toward a system which uses a single temperature sensor to control a plurality of pulse generators during both starting and normal engine operation and in which isolation is provided so that cross-modulation does not occur during the actuation of two or more generators during normal operation.

SUMMARY OF THE INVENTION

The present invention broadly relates to an injector pulse duration control circuit having a number of pulse generators employing a single, common temperature sensor which is switched between a first configuration used during starting of the engine, and a second configuration used during normal running operation. In the first configuraton the pulse duration may be controlled over the wide range required between starting the engine while it is at cold temperature of about minus 20° F., and starting an engine at normal operating temperature. During the running configuration the circuit provides a narrower range of pulse durations to insure an extremely precise relationship between engine temperature and pulse duration for a given set of the other engine operating parameters and isolates the generators from each other so that no crossmodulation will result when the outputs of two generators overlap.

The switching between the starting and run modes primarily effects the interconnection between the engine temperature sensor and the other pulse generator components. In a preferred embodiment of the invention, which will subsequently be disclosed in detail, the temperature sensor takes the form of a thermistor supported to experience a temperature that varies with the engine temperature. The current that flows through this variable resistance or the voltage across the resistance when a controlled current is applied to it, provides the required electrical signal which varies with temperature.

The preferred embodiment of the invention employs resistance-capacitance discharge circuits in each pulse generator as the timing elements for the pulse duration. Each capacitor is initially charged to a voltage which varies with one or more engine operating parameters, such as manifold pressure and the like. On the receipt of a triggering signal generated in timed relation to the engine operation, the capacitor is then discharged through the resistance. The value of the resistance and/or the potential applied to the resistance, to which the capacitor discharges, may be controlled by other engine operating parameters. The output pulse begins when the capacitor starts discharging and continues until it is discharged to a reference voltage.

In the preferred embodiment, during normal engine operation the thermistor is connected in series with the fixed resistances in the discharge path of the capacitors in each generator. A reference voltage is applied to the junction between the fixed resistor and the thermistor so that the two operate as a voltage divider and thereby control the effective voltage to which the capacitor discharges and thus its rate of discharge. A transistor acting as an emitter-follower couples the thermistor to separate discharge resistors in each of the pulse generated circuits to eliminate cross-channel coupling. During engine start-up, the emitter-follower transistor is switched off so that its emitter-base circuit acts as a diode connecting the thermistor to the pulse generator discharge paths; the reference voltage is switched off; and a calibrating resistance is switched into shunting relationship with the thermistor. The thermistor is then part of the discharge path to ground for the capacitors of the pulse generators.

In effect, the circuit switches the change in discharge time of the capacitor which a unit change of engine temperature produces, from a relatively high value during engine starting to a substantially lower value during normal running operation. The circuit thus achieves a wide range pulse duration during starting and a more precise control of pulse duration, as a function of temperture, during running from the same thermistor.

Other objectives, advantages and applications of the present invention will be made apparent by the following detailed description of a preferred embodiment of the invention. The description makes reference to the accompanying drawings in which.

Figures 1, 2:
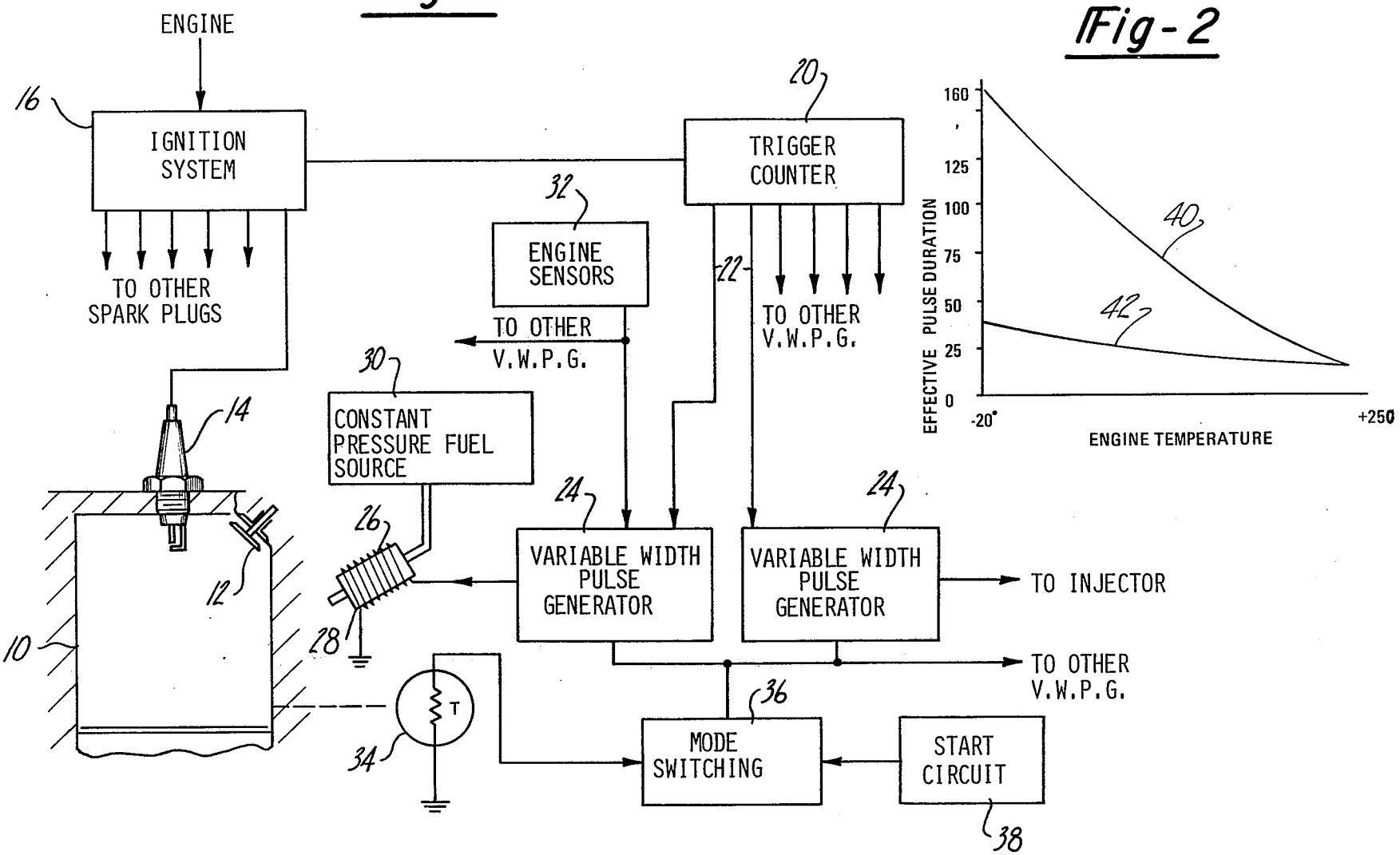
FIG. 1 is a block diagram of a fuel injection system forming a preferred embodiment of the invention.
FIG. 2 is a plot of ignition pulse duration versus engine temperature for starting and normal operating conditions as produced by the system of FIG. 1.

A single cylinder 10, of a multi cylinder engine, and the associated ignition system and fuel injection system are illustrated in FIG. 1.

The fuel charge admitted to the cylinder 10 through an intake valve 12 is ignited by a spark plug 14. The spark plug 14 is energized by an electric pulse provided by the vehicle ignition system 16 which also provides igniting pulses to the spark plugs associated with the other engine cylinders (not shown) in timed relation to the operation of the engine.

Pulses from the ignition system 16 are also provided to a trigger counter 20 so that each pulse advances the state of the counter. The counter has a plurality of output lines 22 which are sequentially energized as the counter is advanced by the pulses from the ignition system. Typically, each of the counter output lines 22 will be high for the period between a particular pair of ignition pulses, once each engine cycle. Each of the lines 22 feeds a variable width pulse generator 24, and the termination of the signal from the counter 20 triggers the generation of a pulse by the particular generator.

A single one of the pulse generators 24 is illustrated in FIG. 1 as connected to the solenoid coil 26 of a fuel injector 28, and the other pulse generators are connected to the coils of injectors associated with the other engine cylinders (not shown). The injector 28 takes the form of a normally closed valve connected to a constant pressure fuel source 30. When the coil 26 is energized by a pulse from the generator 24 the injector valve 28 is opened and dispenses a volume of fuel to the area of the intake valve 12, externally of the cylinder 10. When the intake valve 12 opens, this fuel charge is admitted to the cylinder.

The quantity of fuel admitted is dependent upon the duration of the pulse from the generator 24. This pulse duration is controlled by a group of engine sensors 32, which provide outputs to each of the variable width pulse generators 24 as a function of engine operating parameters, such as manifold pressure atmospheric pressure, and the like. The pulse width is also controlled as a function of the condition of an engine temperature sensor 34, which preferably takes the form of a thermistor and is connected to each of the variable width pulse generators 24 by a mode switching circuit 36. The switching circuit connects the thermistor 34 to the variable width pulse generators 24 in a manner determined by the presence or absence of a signal from a start circuit 38. A high signal from the start circuit indicates that the engine is being cranked and the absence of high output from the start circuit 38 is indicative of a normal mode of engine operation. In both modes of engine operation the resistivity of the thermistor 34, which is a function of engine temperature, controls the duration of the pulses provided by the generators 24.

In both modes an increase in engine temperature increases the resistance of the thermistor 34 and decreases the duration of the pulses from the generators 24 and thus the quantity of fuel that is injected into the cylinders; but the change in pulse duration produced by a given change of engine temperature is substantially higher during the starting mode than it is during the normal operating mode. This is illustrated in FIG. 2 which plots the injection pulse duration as a function of engine temperature for the start mode by line 40 and for the normal running mode by line 42. It will be noted that the slope of line 40 is much steeper than that of line 42 indicating the greater effect of a given temperature change on the injected fuel quantity during starting, considering all other engine parameters to be constant.

Figures 3, 4, 5:
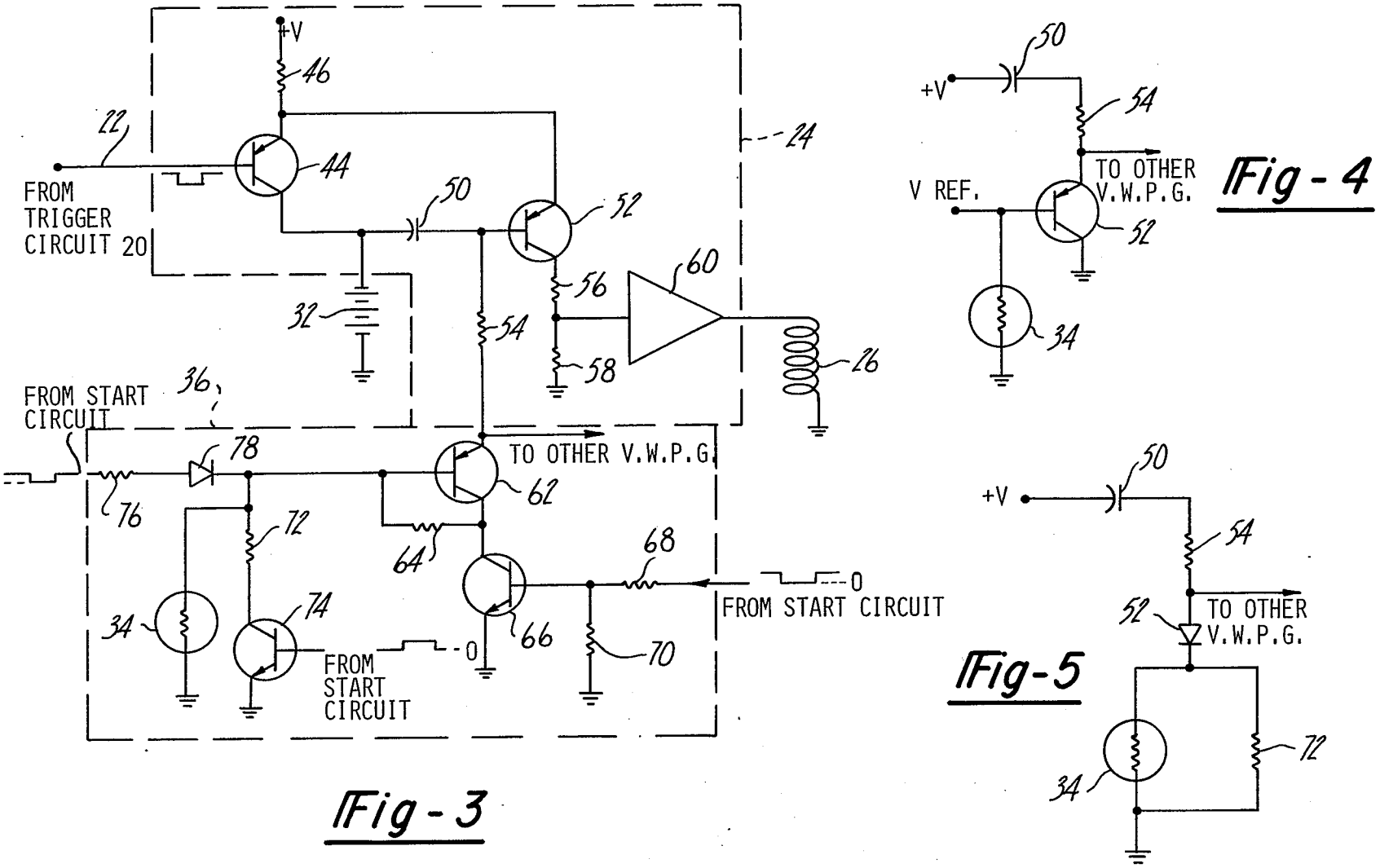
FIG. 3 is a detailed schematic diagram of a preferred embodiment of the pulse generator, thermistor, and switching circuit employed in the system of FIG. 1.
FIG. 4 is an equivalent diagram of the thermistor-pulse generator interconnection during running operation.
FIG. 5 is an equivalent diagram of the thermistor pulse generator interconnection during starting operation of the engine.

The preferred embodiment of the variable width pulse generator 24 and a mode switching circuit 36 are illustrated in more detail in FIG. 3. The triggering signals on line 22 take the form of negative-going pulses which are applied to the base of a PNP transistor 44 that has its emitter connected to the positive terminal of the power supply through a resistor 46.

The collector of transistor 44 is connected to ground through the sensor 32, which acts like a variable voltage source, and is schematically designated as such. Circuit 32 is controlled by various engine operating parameters and in the preferred embodiment of the invention its potential is primarily a function of the engine manifold pressure. In alternative embodiments, other combinations of parameters could be used to determine the voltage provided by device 32.

The collector of transistor 44 is also connected to one terminal of a capacitor 50 which has its other terminal connected to the base of a second PNP transistor 52 and also to ground through a resistor 54 and the mode control circuit 36. The emitter of transistor 52 is connected to the positive terminal of the power supply through resistance 46 and its collector is connected to ground through a pair of resistances 56 and 58. The midpoint of these resistances is connected to a driver amplifier 60 which provides the output of the circuit and connects to the solenoid coil 26 of the injector 28.

In the absence of a negative-going pulse on line 22 from trigger circuit 20 the transistor 44 operates in a saturated conduction region. The transistor 52 is then also conductive and the voltage across the capacitor 50 is maintained substantially at zero. When the trigger circuit 20 provides a negative-going pulse to the base of transistor 44, that transistor is switched out of conduction, allowing the capacitor 50 to be charged to a voltage that is dependent upon the effective voltage of the sensor circuit 32 and the emitter voltage of transistor 52.

When the negative-going pulse to the base of transistor 44 terminates, that transistor immediately becomes conductive again and the voltage at the base of transistor 52 goes sharply positive by an amount proportional to the charge on the capacitor 50, turning off transistor 52. The capacitor 50 then begins to discharge through the resistance 44 and the mode control circuit 36. This discharge continues until the voltage across at the base of transistor 52 decays to a value substantially equal to the emitter voltage of transistor 52, causing transistor 52 to turn on, and to clamp the voltage on the capacitor.

In the mode control circuit 36, the discharge resistance 54 is connected to the emitter of a PNP transistor 62 which has a shunting resistor 64 connected between its base and collector. The collector of transistor 62 also connects to the collector of a NPN transistor 66 which has its emitter grounded and its base connected to the start circuit through resistance 68 and to ground through a resistance 70. The base of transistor 62 is connected to ground through the thermistor 34 as well as through a resistance 72 and the emitter-collector circuit of an NPN transistor 74. The base of the transistor 74 connects to the start circuit.

The base of the transistor 62 is also connected to the start circuit through a resistor 76 and a diode 78. The start circuit connection to the resistor 76 is normally high in the absence of energization of the start circuit, and drops to zero volts when the start circuit is energized. This positive voltage acts as a reference voltage. The inputs provided by the start circuit to the bases of transistors 66 and 74 are normally at zero level, and go high when the start circuit is energized. Accordingly, in the absence of energization of the start circuit, during normal operation of the engine, transistor 66 is conductive and shorts the collector of transistor 62 to ground so that transistor 62 is connected in an emitter-follower configuration. When the start circuit is energized, during engine cranking, transistor 66 is turned off, opening the circuit between the collector of transistor 62 and ground. The resistor 54 is then connected to the thermistor through the emitterbase junction of transistor 62 which acts as a diode. At the same time transistor 74 is turned on shunting the thermistor 34 to ground through resistor 74 which acts to calibrate the thermistor. The reference voltage applied through resistor 76 and diode 78 is simultaneously removed.

During normal engine operation the transistor 62 acts as an emitter follower, connecting the resistor 54 to ground through the thermistor 34. The resistor 54 and thermistor 34 thus act as a voltage divider for the reference voltage applied through diode 78. The resistivity of the thermistor 34 thus controls the voltage at the emitter of transistor 62 and thus the rate of discharge of the capacitor 50.

During normal engine operation, particularly at high speeds, overlap may occur between the output signals from various of the pulse generators. The emitter follower connection of the transistor 62 effectively isolates the thermistors from the firing circuits so that no cross-modulation results from these overlaps. The emitter-follower configuration thus isolates the variable width pulse generators from affecting one another during normal engine operation.

When the start pulse is received the transistor 62 is converted into an effective diode and the resistor 72 is shunted across the thermistor 34. The capacitor 50 then discharges to ground through the series combination of the resistor 54 and the effective resistance provided by the thermistor 34 and the calibrating resistor 72. Thus the thermistor 34 affects the discharge rate of the capacitor 50 in substantially different manners during normal and starting operation, but in both modes the rate of discharge is controlled as an inverse function of the resistance of thermistor 34.

Assuming that the resistance 54 is about 20,000 ohms and that the resistance of the thermistor may vary from practically zero at 250° F. to about 200,000 ohms at −20° F. During starting operation the resistance of the discharge path for the capacitor 50 may vary by factor of 10 as a function of the engine temperature and thus the time constant of the R-C circuit is varied by a factor of 10. During normal running operation the voltage to which the capacitor 50 discharges may vary by a factor of two as the thermistor undergoes the full temperature range.

FIG. 4 illustrates the equivalent construction of the R-C circuit during normal engine operation while FIG. 5 illustrates the equivalent circuit during starting operation. It will be noted that the element 52 is illustrated as a transistor in FIG. 4 and as a diode in FIG. 5, its function during these two modes.

The embodiments of the invention in which an exclusive property or privilege is claimed are defined as follows:

1. In a fuel injection system for a multicylinder engine, having a fuel source, electrically energized injectors associated with each cylinder, a plurality of variable width pulse generators controlling the injectors, and an electric circuit which is energized during the starting of the engine, the improvement comprising: a sensor disposed with respect to the engine to experience a temperature related to the engine temperature and having an electric property which has a specific value for each temperature and varies as a function of such temperature; and switching means, responsive to energization of said start circuit for connecting said temperature sensor to all of the variable width pulse generators in a first electronic configuration during energization of said start circuit, wherein decreased engine temperature effects a relatively great increase in duration of each of the pulses generated by said pulse generators, said switching means assuming a second electronic configuration, when said start circuit is not energized, wherein the output of the temperature sensor controls the durations of the pulses provided by each of the pulse generators, and the pulse generators are connected to the temperature sensor so that decreased engine temperature effects a relatively small increase in pulse duration.

2. The fuel injection system of claim 1 wherein said engine temperature sensor comprises a thermistor.

3. The fuel injection system of claim 1 wherein said variable width pulse generators each include a resistance-capacitance timing circuit and the manner of connection of the engine temperature sensor to the variable width pulse generators affects the discharge time of the timing circuit.

4. The fuel injection system of claim 3 wherein the resistance-capacitance timing circuits each include a capacitor, circuitry for charging the capacitor to a voltage which is a function of at least one engine operator parameter, and means for allowing discharge of the capacitor through the resistance.

5. The fuel injection system of claim 4 wherein said switching means connects said engine temperature sensor to each of the resistance-capacitance timing circuits during normal engine operation, to control the voltage to which the capacitors discharge.

6. The fuel injection system of claim 5 wherein said engine temperature sensor comprises a thermistor and the variable width pulse generators each include a source of reference voltage, a resistor connected to the source of reference voltage and means for connecting said resistors of each of said generators to said thermistor during normal engine operation to control the voltage to which the capacitor discharges.

7. In a fuel injection system for a multicylinder engine having an electrically energized injector associated with each cylinder and a plurality of sequentially triggered variable width pulse generators controlling the injectors, an electric circuit which is energized during the starting of the engine, a sensor disposed with respect to the engine to experience a temperature related to the engine temperature, the sensor having an electric property which varies as a function of such temperature, and electric circuitry interconnecting the sensor and each of the variable width pulse generators, the circuitry being controlled by the condition of the start circuit for connecting the temperature sensor to each of the pulse generators in a first electronic configuration during energization of said start circuit, wherein said temperature sensor is directly connected into the timing circuit of each of said pulse generators, said circuitry assuming a second electronic configuration, when said start circuit is not energized, wherein said temperature sensor is connected to each of said discharge circuits so that the operation of any discharge circuit does not effect the operation of any other discharge circuit.

8. In a fuel injection system for a multi-cylinder engine, having a fuel source, electrically energized injectors associated with each cylinder, a plurality of variable width pulse generators controlling the injectors, and an electric circuit which is energized during the starting of the engine, the improvement comprising: a thermistor disposed with respect to the engine to experience a temperature related to the engine temperature; and switching means, controlled by said start circuit for connecting said thermistor to all of the variable width pulse generators in either a first configuration during energization of said start circuit, wherein changes in engine temperature effect a relatively great change in duration of the pulses generated, or in a second configuration, when said start circuit is not energized, wherein the output of the thermistor controls the durations of the pulses provided by each of the generators, and the generators are connected to the thermistor so that changes in engine temperature effect a relatively small change in pulse duration, each of said variable width pulse generators including a resistance-capacitance timing circuit and the manner of connection of the thermistor to the variable width pulse generators affecting the discharge time of the timing circuit, each of the resistance-capacitance timing circuits including a capacitor, circuitry for charging the capacitor to a voltage which is a function of at least one engine operating parameter, and means for allowing discharge of the capacitor through the resistance, said switching means connecting said thermistor to each of the resistance-capacitance timing circuits during normal engine operation, to control the voltage to which the capacitors discharge, each of said variable width pulse generators including a source of reference voltage, a resistor connected to the source of reference voltage and means for connecting said resistors of each of said pulse generators to said thermistor during normal engine operation to control the voltage to which the capacitor discharges, said switching means connecting said thermistor in the discharge paths of said capacitors, during energization of the starting circuit, so that the discharge current flows through said thermistor.

9. The fuel injection system of claim 8 wherein said means for connecting said resistors of each of said pulse generators to said thermistor during normal engine operation comprises a transistor connected in an emitter-follower circuit so that the voltage across the thermistor is not affected by the activation of any of the pulse generators.

10. The fuel injection system of claim 8 wherein said means for connecting said resistors of each of said pulse generators to said thermistor during normal engine operation comprises a transistor having each of said resistors connected to its emitter, having a source of reference voltage connected to its base and having the thermistor connected between its base and ground, whereby the voltage drop across the thermistor is independent of the function of any of said pulse generators fired.

* * * * *